US006585336B2

(12) United States Patent
Munday et al.

(10) Patent No.: US 6,585,336 B2
(45) Date of Patent: Jul. 1, 2003

(54) DRAWER SLIDE HAVING ADJUSTMENT DEVICE

(75) Inventors: Steven R. Munday, Stryker, OH (US); Troy E. Tedrow, Wauseon, OH (US); Terry W. Armey, Napoleon, OH (US); Brian D. Fritch, Stryker, OH (US); Tsuang Lung Lin, Kaohsiung Hsien (TW)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 09/951,078

(22) Filed: Sep. 12, 2001

(65) Prior Publication Data

US 2002/0043914 A1 Apr. 18, 2002

Related U.S. Application Data

(60) Provisional application No. 60/239,783, filed on Oct. 12, 2000.

(51) Int. Cl.[7] ..... A47B 88/00

(52) U.S. Cl. ..... 312/334.4; 312/334.12

(58) Field of Search ..... 312/334.4, 334.5, 312/330.1, 334.12, 334.1, 334.7, 334.8

(56) References Cited

U.S. PATENT DOCUMENTS

| | | | | |
|---|---|---|---|---|
| 3,113,818 A | * | 12/1963 | Armentrout et al. | 312/334.4 |
| 3,701,577 A | | 10/1972 | Fischer | |
| 3,973,814 A | | 8/1976 | Entrikin | |
| 4,121,878 A | | 10/1978 | Lokken | |
| 4,212,445 A | * | 7/1980 | Hagen | 248/245 |
| 4,288,137 A | | 9/1981 | MacDonald | |
| 4,291,929 A | * | 9/1981 | Faust | 312/334.4 |
| 4,440,460 A | | 4/1984 | Brighoff | |
| 4,679,950 A | * | 7/1987 | Delmege et al. | 312/333 |
| 4,692,035 A | | 9/1987 | Rock et al. | |
| 4,927,216 A | | 5/1990 | Boda | |
| 5,163,774 A | * | 11/1992 | Lautenschlager | 312/330.1 |
| 5,292,192 A | | 3/1994 | Lautenschlager | |
| 5,375,922 A | * | 12/1994 | Brustle et al. | 312/334.4 |
| 5,449,231 A | | 9/1995 | Lin | |
| 5,484,198 A | | 1/1996 | Pilliod | |
| 5,490,724 A | | 2/1996 | Domenig | |
| 5,556,182 A | * | 9/1996 | Lai | 312/334.4 |
| 5,634,703 A | | 6/1997 | Vonier | |
| 5,785,400 A | | 7/1998 | Grieser et al. | |
| 5,897,178 A | * | 4/1999 | Ohara | 312/334.4 |
| 6,106,185 A | * | 8/2000 | Isele et al. | 312/334.5 |
| 6,267,113 B1 | * | 7/2001 | Maust et al. | 126/512 |
| 6,402,276 B1 | * | 6/2002 | King | 312/334.5 |

FOREIGN PATENT DOCUMENTS

| | | | | |
|---|---|---|---|---|
| DE | 2424-145 A1 | | 11/1975 | |
| DE | 2513-647 A1 | | 12/1976 | |
| GB | 2095537 | * | 10/1982 | 311/334.5 |

OTHER PUBLICATIONS

Brochure entitled "The Catalina Collection, Model #7815 5–Drawer Chest", Sauder Woodworking Co., Apr. 1995, pp. 1–3 and 10–12.

* cited by examiner

*Primary Examiner*—Lanna Mai
*Assistant Examiner*—Hanh V. Tran
(74) *Attorney, Agent, or Firm*—Emch, Schaffer, Schaub & Porcello Co., L.P.A.

(57) ABSTRACT

A drawer slide having an adjustment device including a cam. The cam can be actuated to adjust the position of the drawer slide with respect to a drawer to which the drawer slide is attached.

7 Claims, 4 Drawing Sheets

DRAWER SLIDE HAVING ADJUSTMENT DEVICE

RELATED APPLICATION

This application is related to and claims the benefit of U.S. provisional application Serial No. 60/239,783, filed on Oct. 12, 2000.

BACKGROUND OF THE INVENTION

The present invention relates generally to a drawer slide having an adjustment device for adjusting the position of the drawer slide with respect to a drawer.

A drawer slide is positioned between, for example, a drawer and a cabinet to allow the drawer to move in and out of the cabinet. There is a need for a drawer slide that can be easily adjusted to properly position the drawer with respect to the cabinet. The present invention satisfies this need.

SUMMARY OF THE INVENTION

The present invention is directed to a drawer slide having, among other things, a cam for insertion in a corresponding opening of a drawer to which the drawer slide is attached. The cam can be rotated and slid to engage a wall of the drawer opening to cause movement of the drawer slide to adjust the drawer slide with respect to the drawer.

The primary object of the present invention is to provide a drawer slide having an adjustment device.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
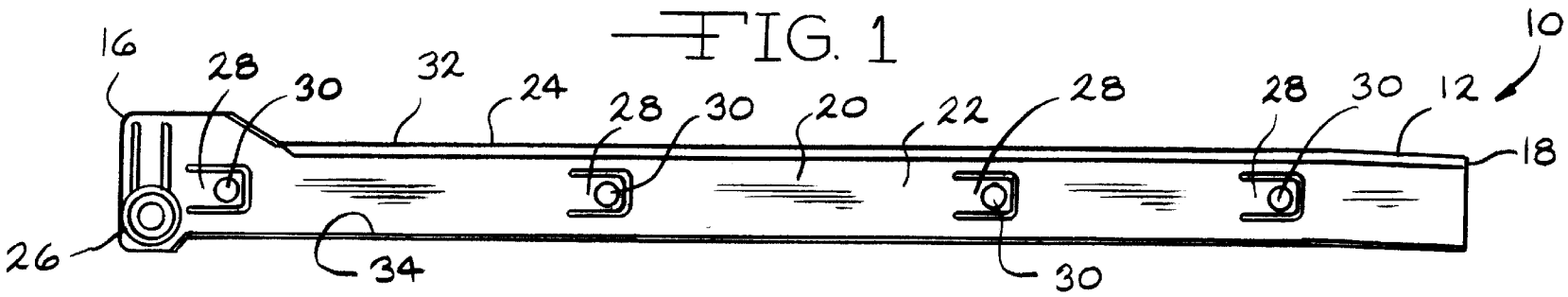
FIG. 1 is a side elevational view of a first member of a first embodiment drawer slide according to the present invention.

The preferred embodiments and best mode of the present invention will now be described in detail with reference being made to the drawings. The drawer slide of the present invention is indicated generally in the drawings by the reference number "10".

A first embodiment drawer slide is shown in FIGS. 1–6. The drawer slide 10 includes a first member 12 and a second member 14. The first member 12 includes a first end 16 and a second end 18. An elongated body 20 having an inside wall 22 and an outside wall 24 extends between the first and second ends 16 and 18. As shown in FIG. 1, the inside wall 22 includes a wheel 26 rotatably mounted at the first end 16. Still referring to FIG. 1, the first member 12 includes tabs 28 having openings 30. The first member 12 includes an upper rail 32 and an opposed lower rail 34 positioned adjacent to the inside wall 22.

Referring to FIGS. 2–6, the second member 14 includes a front end 36 and a back end 38. An elongated center 40 having an inner wall 42 and an outer wall 44 extends between the front and back ends 36 and 38. A wheel 46 is rotatably mounted on the inner wall 42 adjacent to the back end 38. The second member 14 further includes a top rail 48 positioned adjacent to the inner wall 42.

Figure 2:
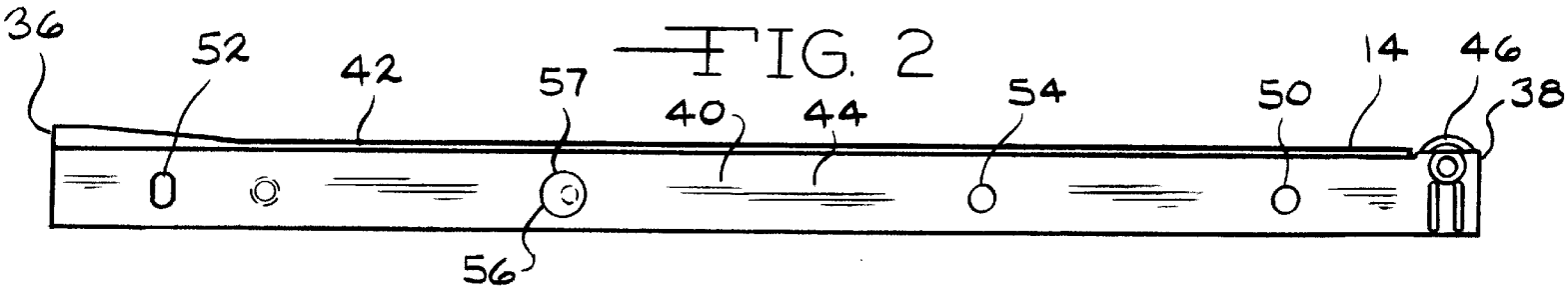
FIG. 2 is a side elevational view of a second member of a first embodiment drawer slide according to the present invention.

As shown in FIG. 2, the second member 14 includes a rounded, generally circular pivot opening 50 and an adjustment opening 52 having an elongated, generally oval shape. The second member 14 can also include other openings such as opening 54.

Figure 4:
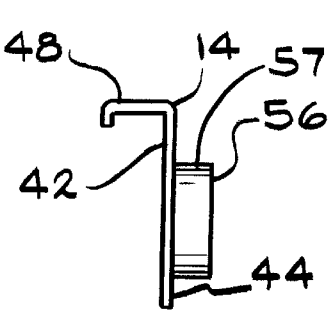
FIG. 4 is a detailed view of the second member showing the cam mounted thereon.
Figure 3:
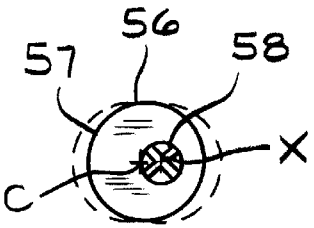
FIG. 3 is a detailed view of a cam according to the present invention.
Figure 10:
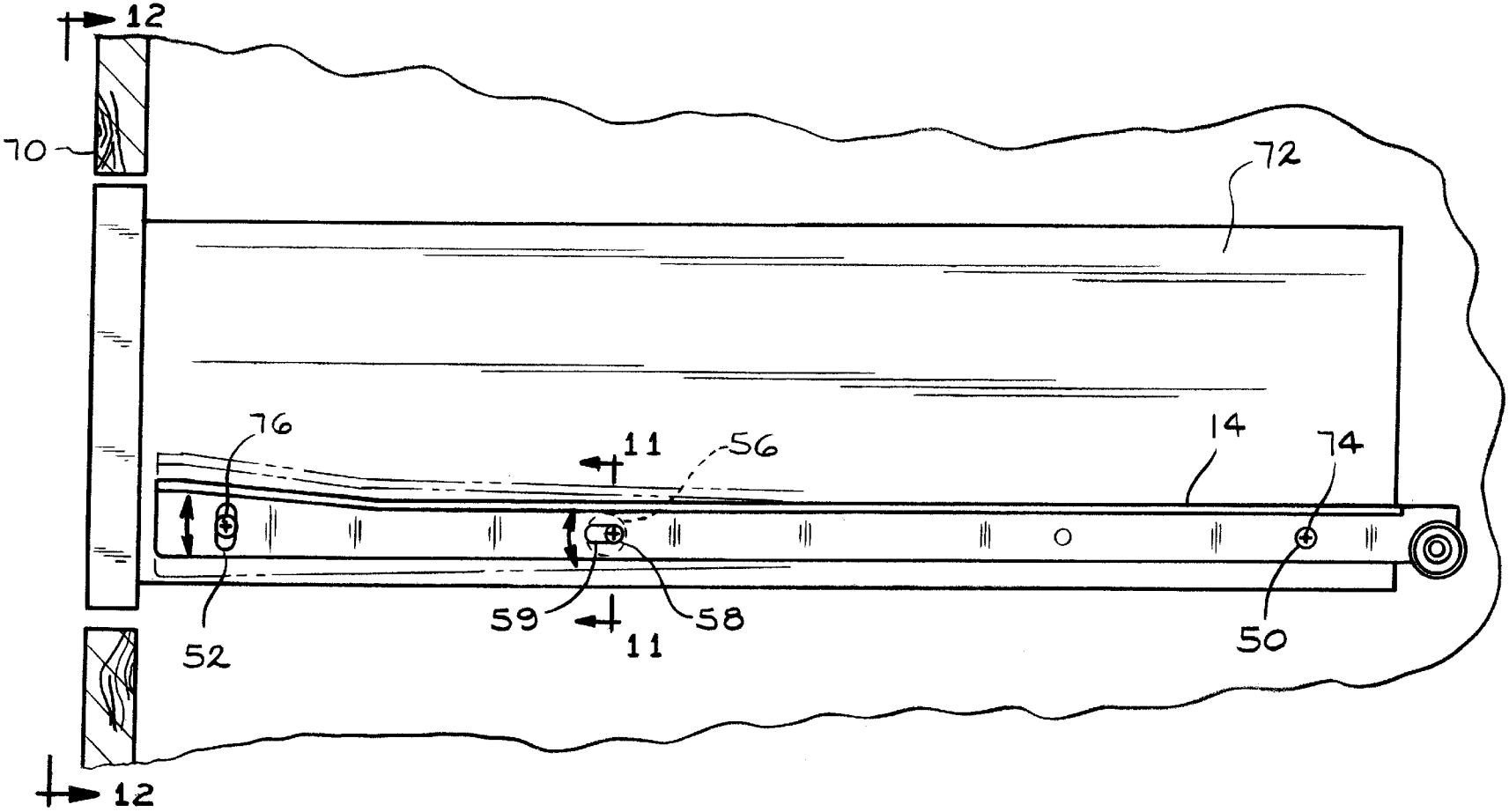
FIG. 10 is a side elevational view of a second member of the first embodiment drawer slide according to the present invention mounted on a drawer positioned in a cabinet.
Figure 11:
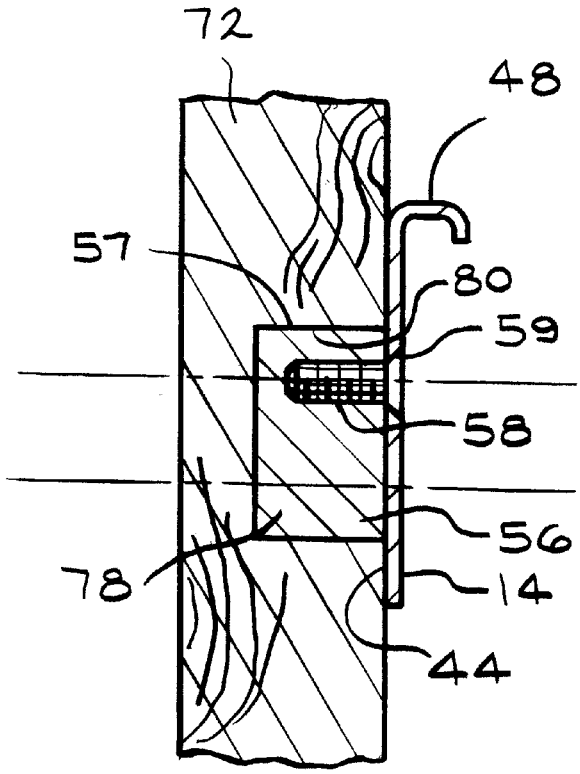
FIG. 11 is a cross-sectional view taken along line 11—11 of FIG. 10.

Referring to FIGS. 2–4, 10 and 11, the second member 14 includes a rotatably and slideably mounted cam 56 having a rounded, generally circular, exterior surface 57. As shown in FIG. 4, the cam extends outwardly from the outer wall 44. As shown in FIG. 3, the center of the cam 56 is indicated by the reference letter "C". As shown in FIGS. 3, 10 and 11, the cam 56 is mounted off-center from the center C at, for example, a point X by a driver device 58 that extends through an elongated, generally oval device opening 59 in the second member 14. The driver device 58 can be actuated to cause the rotation and movement of the cam as indicated by the broken lines in FIG. 3.

Figure 6:
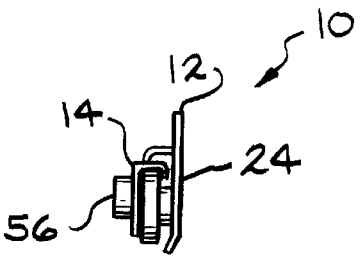
FIG. 6 is a detailed view of the first and second members of the first embodiment drawer slide adapted for a right hand drawer mount.
Figure 7:
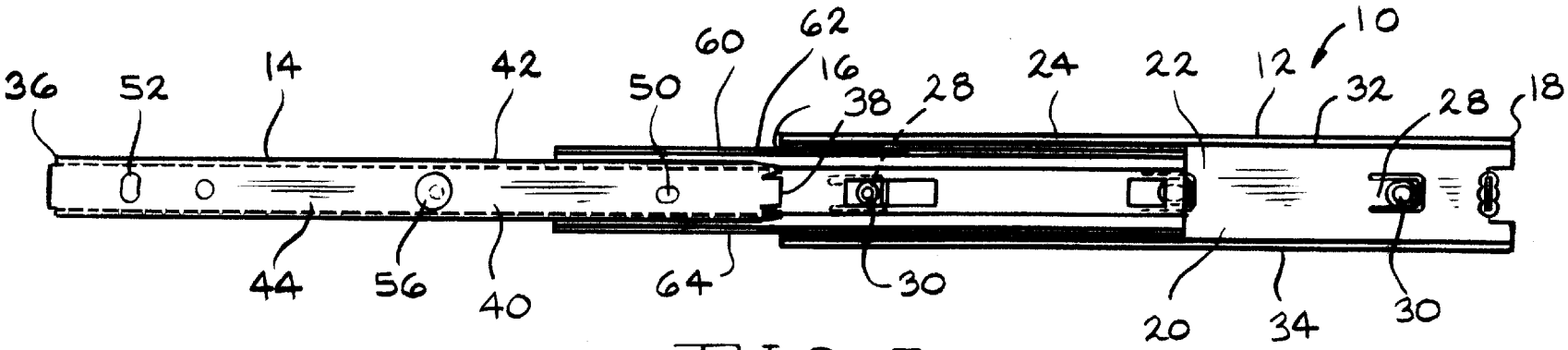
FIG. 7 is a side elevational view of a second embodiment drawer slide according to the present invention.
Figure 9:
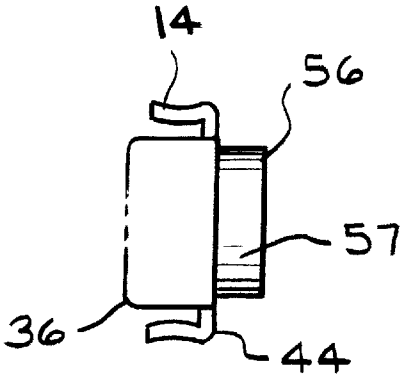
FIG. 9 is a detailed view of the second embodiment drawer slide showing the cam mounted thereon.
Figure 8:
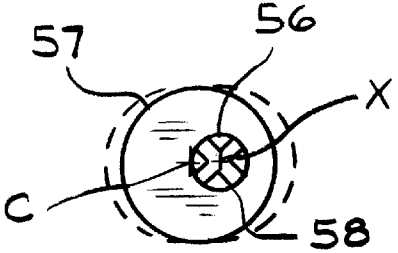
FIG. 8 is a detailed view of a cam for the second embodiment drawer slide.

A second embodiment drawer slide is shown in FIGS. 7–9. This embodiment is directed to a "full extension" drawer slide. As shown in FIG. 7, the second embodiment drawer slide 10 includes the elements described above with respect to the first embodiment drawer slide 10 shown in FIGS. 1–6. Accordingly, the same reference numbers are used with respect to these elements in FIGS. 7–9.

As shown in FIG. 7, the second embodiment drawer slide 10 includes a center extension member 60 that is positioned between the first and second members 12 and 14. The center extension member 60 is slideably mounted by conventional bearings in the upper and lower rails 32 and 34 of the first member 12. The second member 14 is slideably mounted by conventional bearings in the first and second rails 62 and 64 of the center extension member 60.

Figure 5:
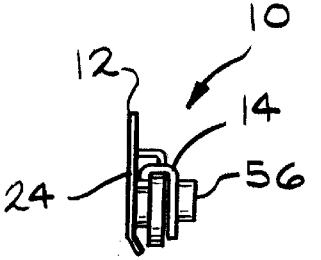
FIG. 5 is a detailed view of the first and second members of the first embodiment drawer slide adapted for a left hand drawer mount.

Referring to FIGS. 1, 2, 5, 6 and 10–12, the first member 12 is attached to an object, such as a cabinet 70, by fastening devices, such as screws (not shown), that extend through the openings 30. As shown in FIG. 10, the second member 14 is attached to an object, such as a drawer 72, by fastening devices, such as screws 74 and 76, that extend through the pivot opening 50 and the adjustment opening 52, respectively. As shown in FIG. 11, the cam 56 is positioned in a drawer opening 78 defined in part by an annular wall 80 having a shape corresponding to the shape of the exterior surface 57 of the cam 56. FIG. 5 shows a first embodiment drawer slide 10 adapted for a left hand mount and FIG. 6 shows a first embodiment drawer slide 10 adapted for a right hand mount, which is also shown in FIG. 10.

Figure 12:
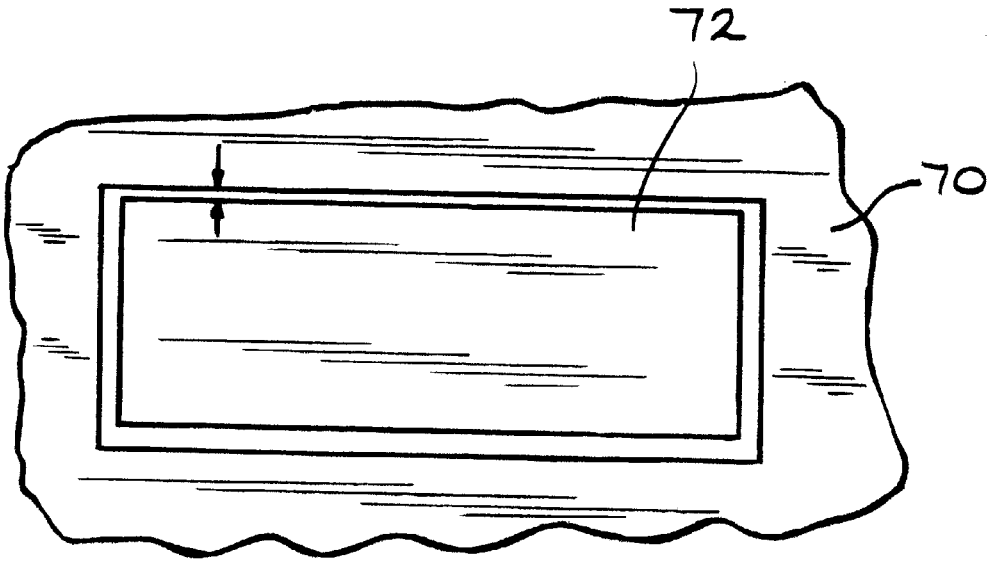
FIG. 12 is a view taken along line 12—12 of FIG. 10 showing the relative positioning of the drawer and the cabinet shown in FIG. 10.

Referring to FIGS. 3 and 10–12, the drawer slide 10 can be adjusted by applying a tool, such as a screwdriver (not shown), to the driver device 58 of the cam 56 to cause the cam 56 to rotate and slide with respect to the second member 14 while the exterior surface 57 engages the annular wall 80 of the drawer opening 78. This is done when the screw 74 positioned in the pivot opening 50 and the screw 76 positioned in the adjustment opening 52 are loose. The screw 74 in the pivot opening 50 acts as a pivot point for the second member 14. As shown in FIG. 10, the movement of the cam 56 results in corresponding movement of the second member 14 with respect to the drawer 72 as indicated by the broken lines. When the second member 14 is properly positioned with respect to the drawer 72, the screws 74 and 76 are tightened to hold the second member 14 firmly in place on the drawer 72. The adjustment of the second member 14 with respect to the drawer 72 results in proper alignment or positioning of the drawer 72 with respect to the cabinet 70 as shown in FIG. 12. The use of the second embodiment drawer slide 10 as shown in FIGS. 7–9 is the same as described above with respect to the first embodiment drawer slide 10.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A drawer slide comprising:

a first member;

a second member adapted for sliding engagement with said first member, said second member having an inner wall, an outer wall, a pivot opening, an elongated adjustment opening spaced from said pivot opening, and an elongated device opening positioned between said pivot and adjustment openings; and an eccentric cam being movably mounted on said outer wall of said second member by a driver device positioned in said device opening whereby actuation of said driver device causes movement of said cam to pivotally adjust said second member with respect to a drawer in which said cam is positioned.

2. The drawer slide of claim 1, wherein:

said first member includes a first end and a second end, said first member further including an elongated body having an inside wall and an outside wall extending between said first and second ends; and said second member includes a front end and a back end, said second member further including an elongated center having said inner wall and said outer wall extending between said front and back ends wherein said inside wall of said first member faces said inner wall of said second member.

3. The drawer slide of claim 1, wherein said first member includes a wheel for engaging a portion of said second member.

4. The drawer slide of claim 1, wherein said first member includes at least one tab having an opening.

5. The drawer slide of claim 2, wherein said first member includes an upper rail and an opposed lower rail positioned adjacent to said inside wall.

6. The drawer slide of claim 1, wherein said second member includes a wheel for engaging a portion of said first member.

7. The drawer slide of claim 2, wherein said second member includes a top rail positioned adjacent to said inner wall.

* * * * *